US005892887A

United States Patent [19]

Thomas et al.

[11] Patent Number: 5,892,887

[45] Date of Patent: Apr. 6, 1999

[54] ELECTRIC WATER HEATER WITH A PAIR OF INTERCONNECTED HEATING CHAMBERS HAVING CONCENTRIC COPPER TUBE STRUCTURES

[75] Inventors: William O. Thomas, Plano, Tex.; Jimmie L. Riley, Sr., Baker, La.

[73] Assignee: Venturi Technologies, Inc., Orem, Utah

[21] Appl. No.: 895,686

[22] Filed: Jul. 17, 1997

[51] Int. Cl.[6] ..... F24H 1/00

[52] U.S. Cl. ..... 392/490; 392/488; 138/143

[58] Field of Search ..... 392/486, 488, 392/489, 490; 138/143, 140, 153; 165/DIG. 534, DIG. 532, 177

[56] References Cited

U.S. PATENT DOCUMENTS

| | | | |
|---|---|---|---|
| 877,177 | 1/1908 | D'Olier, Jr. | 392/490 |
| 1,965,218 | 7/1934 | Carr | 392/490 |
| 2,228,076 | 1/1941 | Flavin | 138/140 |
| 2,511,635 | 6/1950 | Holmes | 392/490 |
| 2,987,604 | 6/1961 | Swoyer | 392/490 |
| 3,280,299 | 10/1966 | Doniak | 392/490 |
| 4,023,557 | 5/1977 | Thorne et al. | 138/143 |
| 4,567,350 | 1/1986 | Todd, Jr. | 392/486 |
| 5,129,034 | 7/1992 | Sydenstricker | 392/486 |
| 5,216,743 | 6/1993 | Seitz | 392/490 |
| 5,408,578 | 4/1995 | Bolivar | 392/490 |

FOREIGN PATENT DOCUMENTS

| | | | |
|---|---|---|---|
| 822983 | 1/1938 | France | 138/140 |
| 858615 | 12/1952 | Germany | 138/140 |
| 750915 | 6/1956 | United Kingdom | 392/490 |
| 1244938 | 9/1971 | United Kingdom | 138/143 |

*Primary Examiner*—John A. Jeffery
*Attorney, Agent, or Firm*—James E. Bradley

[57] ABSTRACT

A water heater for use in a carpet cleaning system has a pair of inner copper tubes which are press fit into outer copper sleeves. Each tube/sleeve combination defines a heating chamber. A hollow tubular bridge extends perpendicularly between and in fluid communication with the heating chambers. A heating element extends coaxially into each heating chamber. A small annular clearance extends between each heating element and inner tube. High pressure fluid enters one of the heating units through an inlet/outlet port and circulates through the bridge to the other heating unit for additional heating. An electronic thermostat is mounted to the exterior surface of each outer sleeve at a desired location to detect the temperature of the fluid by monitoring the temperature of the exterior surface of the heating unit.

7 Claims, 2 Drawing Sheets

ELECTRIC WATER HEATER WITH A PAIR OF INTERCONNECTED HEATING CHAMBERS HAVING CONCENTRIC COPPER TUBE STRUCTURES

TECHNICAL FIELD

This invention relates in general to water heaters and in particular to a carpet cleaning system water heater that is monitored and regulated externally.

BACKGROUND ART

Carpet and upholstery cleaning devices typically direct a stream of water-based cleaning solution directly onto the material to be cleaned. Along with the solution utilized and concurrent vacuuming, the volume and temperature of the solution significantly affect the ability of the cleaning device to remove dirt from the material. Cleaning devices typically use water heaters which have relatively low volume output in order to maintain the proper temperature.

In general, most prior art electric water heaters have a chamber wherein water is circulated around a heating element which heats the water to a desired temperature. The volume of the chamber is usually relatively large compared to the volume required by the heating element. The temperature of the water is monitored by a thermostat which is located within the chamber at some distance from the heating element. The thermostat must also be sealed and insulated and can be rather expensive. Internal thermostats present problems under high pressure operating conditions in the range of 1000 psi.

DISCLOSURE OF INVENTION

A water heater for use in a carpet cleaning system has a pair of inner copper tubes which are press fit into outer copper sleeves. Each tube/sleeve combination defines a heating chamber. A hollow tubular bridge extends perpendicularly between and in fluid communication with the heating chambers. A heating element extends coaxially into each heating chamber. A small annular clearance extends between each heating element and inner tube. High pressure fluid enters one of the heating units through an inlet/outlet port and circulates through the bridge to the other heating unit for additional heating. An electronic thermostat is mounted to the exterior surface of each outer sleeve at a desired location to detect the temperature of the fluid by monitoring the temperature of the exterior surface of the heating unit.

BEST MODE FOR CARRYING OUT THE INVENTION

Figure 1:
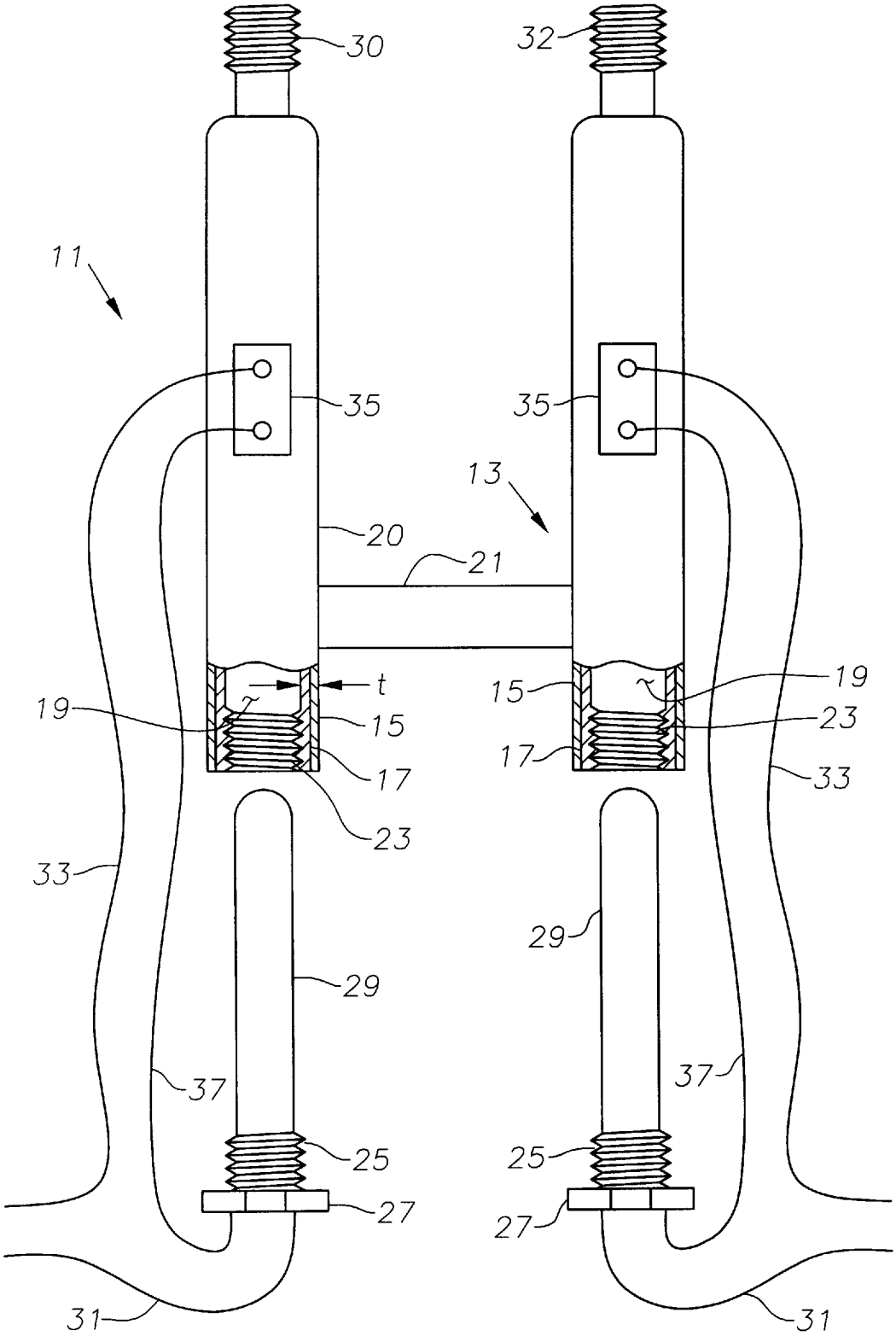
FIG. 1 is a perspective view showing a water heater of the present invention.

Referring to FIG. 1 in the drawings, numeral 11 illustrates a water heater of the present invention. Water heater 11 is designed particularly for use as an in-line water heater in a carpet cleaning system (not shown). A manifold 13 consists of a plurality of tubular sleeves 15, each of which surrounds an interior tube 17. Sleeve 15 and interior tube 17 are preferably made of copper due to its high thermal conductivity. The inside diameter of sleeve 15 is slightly larger than the outside diameter of interior tube 17, such that interior tube 17 is forcibly inserted into sleeve 15, thereby eliminating slippage between sleeve 15 and interior tube 17. The combination of sleeve 15 and interior tube 17 creates a heating chamber 19 in the interior cavity of interior tube 17 which can withstand operating pressures between 1,000 pounds per square inch gauge (psig) and 1,200 psig. This double-walled construction of sleeves 15 and interior tubes 17 forms a heating unit 20 of thickness t, having a desired high pressure strength and thermal conductivity, that is otherwise not commercially available.

After interior tube 17 is inserted into sleeve 15, one or more passage ways (not shown) are bored through the heating unit 20. Hollow tubular bridges 21, preferably made of copper, extend perpendicularly to the longitudinal axes of heating units 20 and are connected to the sleeves 15 such that the passage ways are covered, thereby creating manifold 13 which has a parallel arrangement of heating units 20. Bridges 21 provide fluid communication between heating chambers 19. The interior surface of one end of interior tube 17 of heating unit 20 has threads 23 to matingly receive the threads 25 of hex head bushing 27. Bushing 27 is preferably made of brass. Bushing 27 surrounds and is connected to one end of a heating element 29. Heating element 29 is a conventional electric heating element with a ceramic core and a stainless steel coil terminating at a pair of poles (not shown).

Figure 2:
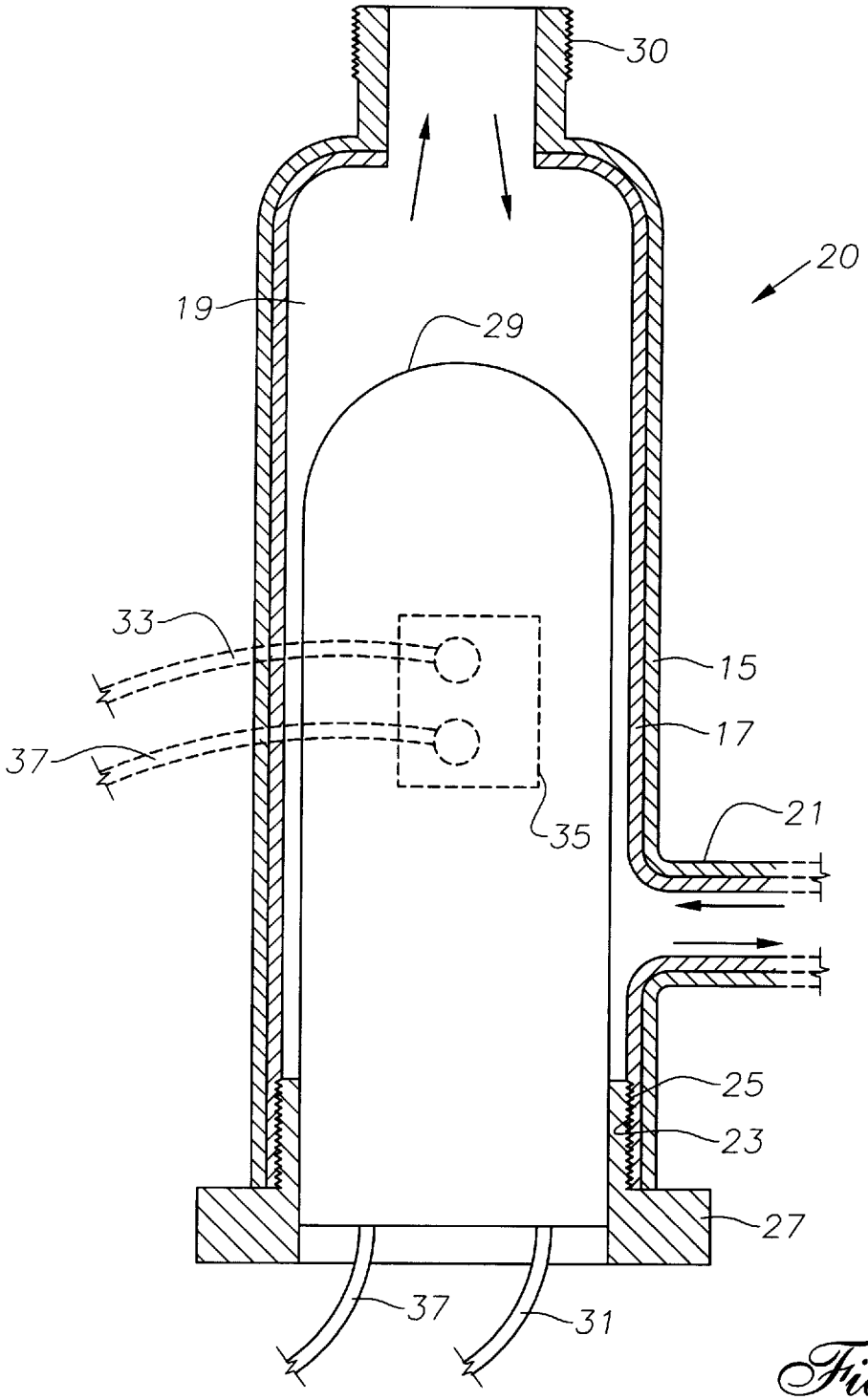
FIG. 2 is an enlarged, partial sectional side view of the water heater of FIG. 1.

As shown in FIGS. 1 and 2, heating element 29 is inserted into heating chamber 19 until threads 23 of interior tube 17 of heating unit 20 are matingly engaged with threads 25 of bushing 27 to form a high pressure seal. The outside diameter of heating element 29 is dimensioned such that a clearance exists between the exterior surface of the coil of heating element 29 and the interior surface of interior tube 17, to allow a desired fluid flow rate through the heating chamber 19. The clearance on a side is very small, between 1/64 and 3/64 inch. Operating fluid, preferably water or a mixture of water and cleaning solution, under operating pressure between 1,000 psig and 1,200 psig, enters the manifold 13 at a desired flow rate, through threaded inlet/outlet port 30 and exits through threaded inlet/outlet port 32. However, manifold 13 is bidirectional so that fluid may enter through port 32 and exit through port 30. As shown in FIG. 2, bridge 21 intersects each heating unit 20 at a point near threaded bushing 27 of each heating element 29.

Electrical lead 31 is conductively connected at one end to a conventional electrical power source (not shown) and conductively connected at its opposing end to a pole of the coil of heating element 29. Electrical lead 33 is conductively connected at one end to the power source and conductively connected at its opposing end to a conventional electric thermostat 35. Electrical lead 37 is conducively connected at one end to the remaining pole of the coil of heating element 29 and conducively connected at its opposing end to the thermostat 35, thereby completing an electrical circuit between the power source, the heating element 29, and the thermostat 35. Thermostat 35 is mounted to the exterior surface of sleeve 15 at a desired location to detect the temperature of the exterior surface of the heating unit 20 and is a high temperature cut-off switch for heating element 29. Preferably thermostat 35 is mounted at the hottest point along sleeve 15 and interior tube 17, which is at the highest watt density of heating element 29. This point is empirically determined and for the embodiment shown, it is closer to port 30 than threads 25.

High pressure fluid flows into the manifold 13 through port 30, filling the heater chamber 19. As electrical current flows from the power source through the coil of the heating element 29, the temperature of the heating element 29 increases. Heat from the coil of the heating element 29 is transferred to the adjacent fluid in the heater chamber 19. The temperature of the fluid rises to a desired operating temperature, preferably between 200 degrees Fahrenheit and 220 degrees fahrenheit. Heat is transferred from the flowing operating fluid to the heating unit 20. The temperature of the exterior surface of heating unit 20 increases proportionally with the temperature of the fluid and is continuously detected by thermostat 35.

When the temperature of the exterior surface of the heating unit 20 reaches a desired maximum limit, the thermostat 35 electronically opens the electrical circuit and eliminates the flow of electrical current to the coil of heating element 29. Unheated fluid entering the heater chamber 19 draws heat from the heating element 29 and from the heating unit 20 as heating element 29 and heating unit 20 cool. When the temperature of the exterior surface of the heating unit 20 reaches a desired minimum limit, the thermostat 35 electronically completes the electrical circuit and restores the flow of electrical current to the coil of heating element 29. This fluid heating cycle is repeated to maintain the fluid in the desired operating temperature range. Each heating unit 20 of the manifold 13 has a corresponding heating element 29 and thermostat 35 and operates independently of other heating units 20.

It should be apparent from the foregoing that an invention having significant advantages has been provided. While the invention is shown in only one of its forms, it is not just limited but is susceptible to various changes and modifications without departing from the spirit thereof.

We claim:

1. A water heater for heating water, comprising:

a conduit having a longitudinal axis and a first port on one end and a receptacle on an opposite end;

a straight rod-shaped electrical heating element located within and coaxial with the conduit, the rod having a base which engages the receptacle;

an annular clearance between the conduit and the eating element;

a second port in a side wall of the conduit near the base of the heating element such that water flowing between the ports flows through the clearance wherein it is heated and out the second port, the heating element having a tip which is spaced closer to the first port than the second port; and a thermostat mounted on an exterior surface of the conduit closer to the first port than the receptacle and at the hottest point of the heating element for externally monitoring a temperature of the water within the chamber by monitoring a temperature of the conduit.

2. The water heater of claim 1 wherein the clearance ranges from 1/64 to 3/64 inches.

3. The water heater of claim 1 wherein the conduit comprises an outer sleeve and an internal tube which is press fit into the outer sleeve to prevent movement therebetween, the internal tube defining a chamber.

4. A water heater having a pair of heating units for heating water, each of the heating units comprising:

a conduit having a longitudinal axis and a port;

a rod-shaped electric heating element extending coaxially within the conduit toward the port and having a base secured to the conduit;

an annular clearance between an inner surface of the conduit and an external surface of the heating element, wherein the clearance is between approximately 1/64 inch and 3/64 inch to allow a desired fluid flow rate at a given pressure through said heating chamber;

wherein the fluid in said conduit is at a pressure between approximately 1000 psig and 1200 psig;

a thermostat mounted on an exterior surface of the conduit for externally monitoring a temperature of the water within the conduit by monitoring a temperature of the conduit; and wherein the water heater further comprises:

a tubular bridge extending between sidewalls of the conduits near the bases of the heating elements for circulating water from the port and through the clearance of one of the heating units, then through the bridge, through the clearance and out the port of the other of the heating units.

5. The water heater of claim 4 wherein the thermostat is located at the hottest point on each of the conduits.

6. The water heater of claim 4 wherein the conduit comprises an outer sleeve and an internal tube which is press fit into the outer sleeve to prevent movement therebetween.

7. A water heater having a pair of heating units or heating water, each of the heating units comprising:

a copper outer sleeve having a longitudinal axis, a port on one end and an opening on an opposite end;

a copper internal tube press fit into the outer sleeve to prevent movement therebetween, the internal tube defining chamber for heating water;

a straight rod-shaped electric heating element extending into the chamber through the opening and having a tip and a base secured to the opening;

an annular clearance between an inner surface of the internal tube and an external surface of the heating element wherein the clearance is between approximately 1/64 inch and 3/64 inch to allow a desired fluid flow rate at a given pressure through said heating chamber;

wherein the fluid in said conduit is at a pressure between approximately 1000 psig and 1200 psig;

a thermostat mounted on an exterior surface of the outer sleeve closer to the ports than to the bases and at the hottest point along the outer sleeves and the interior tubes for externally monitoring the temperature of the water within the chamber by monitoring a temperature of the outer sleeve; and wherein the water heater further comprises:

a tubular bridge extending between the heating units near the bases for circulating water into the port, the chamber and the clearance of one of the heating units, through the bridge, and through the clearance, the chamber and the port of the other of the heating units,wherein said tip of said heating element is spaced closer to the port than the tubular bridge.

* * * * *